United States Patent [19]

Sirotin et al.

[11] Patent Number: 4,461,512

[45] Date of Patent: Jul. 24, 1984

[54] FEED SYSTEM OF A MINING COMBINE

[75] Inventors: Jury G. Sirotin; Stanislav V. Nikolaev; Lazar M. Gelfand; Pavel D. Romanov; Valentin D. Potapov; Mikhail S. Alexeev; Evgeny A. Volkov, all of Tulskaya; Vladlen D. Yalevsky, Kemerovskaya; Viktor G. Lukienko, Tula; Anatoly G. Popov; Grigory A. Tupikov, both of Tulskaya, all of U.S.S.R.

[73] Assignee: Podmoskovny Nauchno-Issledovatelsky I Proektnokonstruktorsky Ugolny Institut, U.S.S.R.

[21] Appl. No.: 432,910

[22] PCT Filed: Feb. 3, 1982

[86] PCT No.: PCT/SU82/00004

§ 371 Date: Sep. 23, 1982

§ 102(e) Date: Sep. 23, 1982

[87] PCT Pub. No.: WO82/02737

PCT Pub. Date: Aug. 19, 1982

[30] Foreign Application Priority Data

Feb. 2, 1982 [SU] U.S.S.R. ..... 3244663

[51] Int. Cl.[3] ..... 421C 27/36

[52] U.S. Cl. ..... 299/42; 105/29 R

[58] Field of Search ..... 299/42, 43, 34; 105/29 R; 74/422

[56] References Cited

U.S. PATENT DOCUMENTS

| | | | |
|---|---|---|---|
| 4,025,120 | 5/1977 | Balinov et al. | 299/34 X |
| 4,082,361 | 4/1978 | Lanfermann | 299/43 |
| 4,155,600 | 5/1979 | Lanfermann et al. | 299/43 |
| 4,184,715 | 1/1980 | Lanfermann | 299/43 |
| 4,186,970 | 2/1980 | Minke et al. | 299/43 |
| 4,326,753 | 4/1982 | Rynik | 299/43 |

FOREIGN PATENT DOCUMENTS

| | | | |
|---|---|---|---|
| 2709111 | 9/1977 | Fed. Rep. of Germany | 299/43 |

*Primary Examiner*—Ernest R. Purser
*Assistant Examiner*—Michael Starinsky
*Attorney, Agent, or Firm*—Lilling & Greenspan

[57] ABSTRACT

A feed system of a mining combine includes a track made up of pivotally interconnected tubular segments on which is installed the combine being moved. The combine has a drive gearwheel meshing with a traction rack. The traction rack is formed by individual pivotally interconnected segments comprising side members interconnected by pins engageable with the drive gearwheel. According to the invention, the traction rack is connected to the track for rotation thereabout by means of pivotal joints which are provided at points of the joints between the segments of the track. Positive engagement of the traction rack with the drive gearwheel is maintained.

3 Claims, 4 Drawing Figures

FEED SYSTEM OF A MINING COMBINE

FIELD OF THE INVENTION

The invention relates to machines for recovering minerals by mining and, more specifically, it deals with feed systems of mining combines.

The invention may be most advantageously used in mechanized complexes designed for working coal deposits and fuel shales.

The invention may also be used in recovering ores of non-ferrous and rare-earth metals occurring in ore seams at various dip angles.

The invention may also find application in other industries where it is desired to ensure a reliable feed of a machine similar to a mining combine or vehicles over a soil surface with an intricate relief with varying slope angles.

DESCRIPTION OF THE PRIOR ART

At present feed systems of mining combines, having as the basic elements a drive gearwheel installed on the combine and a traction rack extending in the direction of the combine movement, are extensively used in mining engineering. The systems of this type seem to be preferable compared with other systems owing to the smoothness of movement, reliability in operation and safety for operators.

Known in the art are numerous structural embodiments of the gearing consisting of a gearwheel and a rack.

In the majority of cases they cannot, however, bring a solution to the problem of ensuring a reliable engagement under complicated conditions associated with an intricate relief of a geological formation; they cannot provide for steering the combine with respect to the face plane either. In one type of such system the pitch of the gearing changes at points where the traction racks are joined to one another, and in another type of such system the traction racks take up various transverse loads.

In the majority of known systems the drive gearwheel of the combine is lifted above the line of action or its valley engages the gear pins. Clogging of the gearing has the same effect. As a result, drive gearwheels, gear pins, the racks themselves and their fasteners would be deformed and rapidly fail.

Known in the art is a feed system of a mining combine (cf. USSR Inventor's Certificate No. 642478, Cl. E 21 C 29/14, publ. 15.01.79, Off. Bull. No. 2, 1979), comprising a round-section track rigidly secured to a conveyor frame. A traction rack having gear pins is rigidly secured to the guide member and to the conveyor frame. A combine having a drive gearwheel or a pin gear meshing with the traction rack is installed on the track and on the conveyor frame. The traction rack is made up of segments. The segments of the traction rack are articulated to one another, the axes of rotation of the segments relative to one another extending below the axes of the gear pins when the traction rack bends.

The disadvantage of this system is misengagement in the gearing consisting of the drive gearwheel and the traction rack upon a change in the relief of the seam or when steering the combine, because the traction rack is rigidly secured to the track and to the conveyor frame.

In addition, when the traction rack is bent together with the track and the conveyor frame upon a change in the relief of the seam, the pitch of the gear pins changes at points of the joints between the segments of the traction rack as the segments rotate about the axes of the pivot joints. This causes misengagement in the gearing consisting of the gearwheel and rack.

SUMMARY OF THE INVENTION

The invention is based on the problem of providing a feed system of a mining combine, wherein, owing to a simple and reliable construction of the traction rack fastening, an optimum engagement in a lantern-wheel gearing is ensured with the drive gearwheel of the combine when it moves in seams with an intricate relief, as well as during steering of the combine.

The invention consists of a feed system of a mining combine, comprising a track made up of individual tubular segments interconnected for limited movement relative to one another, on which is installed a combine having a drive gearwheel meshing with a traction rack extending along the track and consisting of individual segments pivotally connected to one another, each segment comprising side members interconnected by means of equally spaced pins engageable with the drive gearwheel. According to the invention, the traction rack is connected to the track by means of pivotal joints for rotation about the track, the pivotal joints being provided at joints between the track segments, the traction rack being in positive engagement with the drive gearwheel.

This construction of the feed system of a combine ensures optimum contact between the surfaces of engagement in the lantern-wheel gearing (drive gearwheel-traction rack) when the combine operates under complicated seam relief conditions or is turned toward, or away from, the face as dictated by the mining process and operating conditions.

The pivotal joints are preferably formed by pivots having their ends received in adjacent tubular segments of the track for limited axial displacement, and by cantilever arms secured to the middle portions of the pivots, the segments of the traction rack having intermediate members for pivotally interconnecting the segments, which are rigidly secured to the cantilever arms.

This construction provides for continuous and smooth movement of the drive gearwheel over the pins of the traction rack, owing to the fact that a constant pitch of the pins is maintained even upon bending or rotation of the traction rack.

The cantilever arms of the feed system of the mining combine are preferably connected to the intermediate members to which are secured the pins of the adjacent segments of the traction rack in such a manner as to retain the pin pitch of the traction rack therebetween, the segments being rotatable about the pins.

This construction of the traction rack enables its bending upon a change in the seam relief with the lantern-wheel gearing pitch remaining the same, without misengagement in the gearing between the drive gearwheel and the traction rack.

BRIEF DESCRIPTION OF THE DRAWINGS

The invention will now be described with reference to a specific embodiment illustrated in the accompanying drawings, in which.

DETAILED DESCRIPTION OF THE INVENTION

Figure 1:
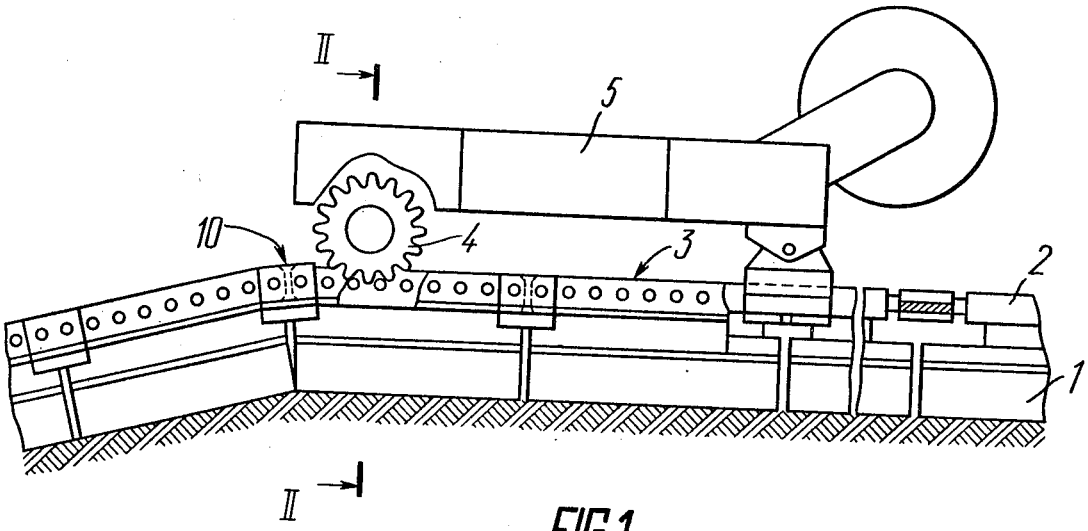
FIG. 1 is a general view of a mining combine having a drive gearwheel meshing with a traction rack, according to the invention.

A feed system of a mining combine according to the invention comprises a conveyor frame 1 (FIGS. 1 and 2) on which are installed on a track 2 and a traction rack 3 extending along the conveyor and engageable with a drive gearwheel 4 installed on the combine 5.

The track 2 is made up of individual tubular segments, preferably of round cross-section, which are connected to one another for limited relative rotation. The tracks used in this invention and shown in FIG. 1 are widely used in the mining engineering, and these tracks are rigidly secured to the frame of the conveyor 1. The combine 5 installed on the track moves therealong.

Figure 3:
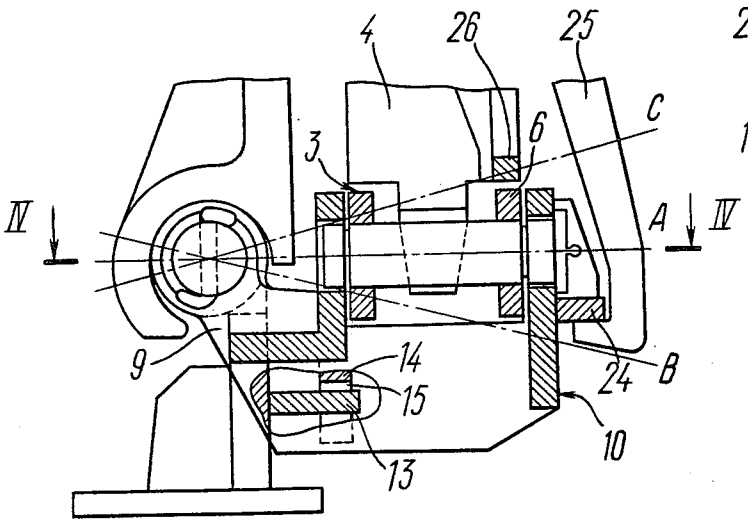
FIG. 3 is a sectional view illustrating the fastening of the traction rack and track, according to the invention.

A traction rack 3, made up of individual segments pivotally connected to one another, is installed along the track. Each segment of the traction rack 3 comprises side members 6 (FIG. 3) interconnected by means of pins 7 (FIG. 4) which mesh with the drive gearwheel 4 (FIG. 3). The pins 7 are equally spaced.

According to the invention, the traction rack 3 is connected to the track 2 for rotation thereabout. The rotation is ensured by the traction rack 3 being connected to the track 2 by means of a pivotal joint provided at joints between segments of the track 2. The traction rack 3 is in positive engagement with the gearwheel 4.

Figure 4:
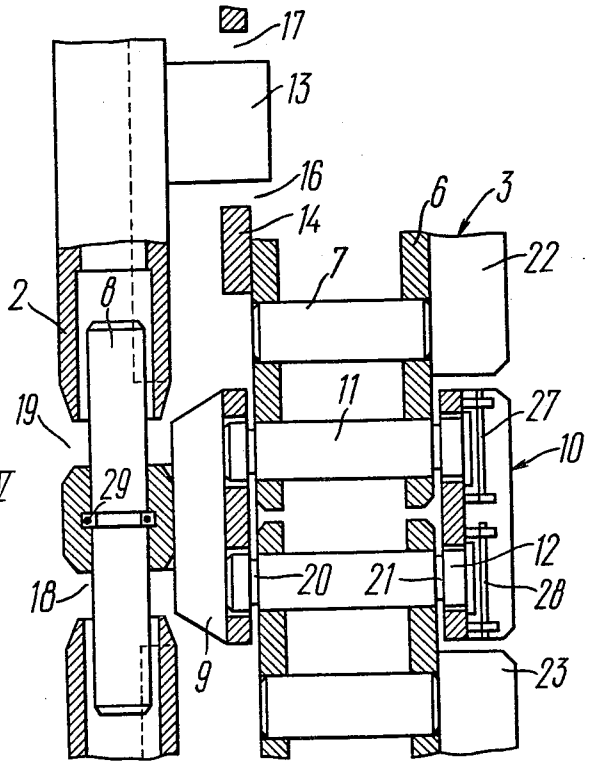
FIG. 4 is a plan view in sectional along the line IV—IV in FIG. 3.

The pivotal joint may be in the form of any joint which enables rotation of the traction rack 3 about the track 2. In this particular embodiment the pivotal joint is formed by pivots 8 (FIG. 4) having their ends received in the tubular tracks 2 for limited axial displacement, and cantilever arms 9 (FIGS. 3 and 4) secured to the middle portions of the pivots 8 (FIG. 4). The segments of traction rack 3 have intermediate members 10 (FIGS. 1, 3 and 4) for pivotal interconnection of the segments of the traction rack 3, the arms 9 being rigidly connected to the segments (FIGS. 3, 4).

In the preferred embodiment of the invention, the arms 9 are connected to the intermediate members 10 to which end pins 11 and 12 of adjacent segments of the traction rack 3 are secured (FIG. 4) in such a manner that they have the same pitch as the pitch of the pins 7 of the traction rack 3, the segments being rotatable about the end pins.

In this embodiment, a compensation clearance is provided between the cantilever arms 9 (FIG. 4) and segments of the tubular track 2 on either side, which permits the conveyor frame 1 (FIG. 1) and tubular segments of the track 2 (FIG. 4) to move toward, and away from, each other when the conveyor bends during the movement or upon changes in the relief of the seam. A stop 13 (FIGS. 3 and 4) is installed on the conveyor frame 1, and a plate 14 is installed on the side member 6 (FIG. 4) and has a recess surrounding the stop 13 with a clearance therebetween. A clearance 15 enables rotation of the traction rack 3 downwards, and clearances 16 and 17 (FIG. 4) in the longitudinal direction will be closed before clearances 18 and 19 will (FIG. 4), so as to protect the cantilever arm 9 against bending under the action of traction forces of the drive gearwheel 4.

In the preferred embodiment, the gearing between the drive gearwheel and the traction rack is in the form of a lantern-wheel gearing. The end pins 11 and 12 are removable to facilitate assembly and disassembly of the traction rack 3 and the cantilever arm 9. In addition, the end pins 11 and 12 are used as protective members of the traction rack 3, and for that purpose they are made with grooves 20 and 21 designed for an ultimate design traction force of the combine acting on the traction rack 3. In case of an overload the end pins 11 or 12 are shorn at the grooves 20 and 21. Thus most intricate and expensive parts of the traction rack are protected against damage which is important because their replacement is a labour-consuming operation. In addition, the safety of mining operations with the combine incorporating the rack feed system is improved. The replacement of the shorn pins 11 and 12, which are easy to make, is simple and does not take much time.

Figure 2:
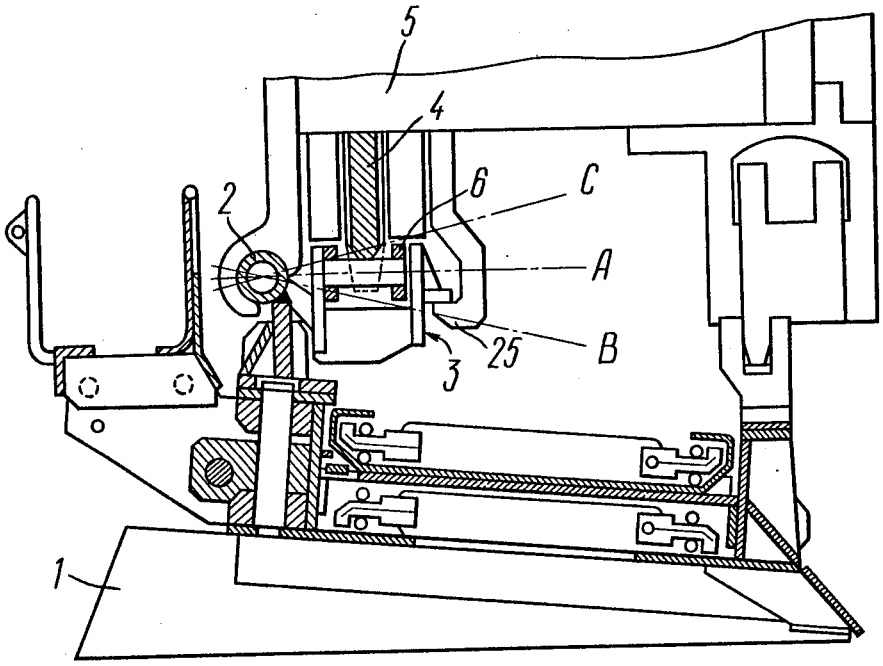
FIG. 2 is a cross-sectional view taken along the line II—II in FIG. 1.

In the specific embodiment of the positive engagement in the gearing consisting of the drive gearwheel and traction rack (as shown in FIGS. 1 and 2) the segments of the traction rack 3 (FIG. 4) have projections 22 and 23 and the intermediate member 10 (FIGS. 3 and 4) has a corresponding projection 24. The combine 5 has an arm 25 (FIGS. 2 and 3) mounted for slidingly engaging the projections 22, 23 and 24 of the traction rack 3. This construction ensures a reliable engagement of the traction rack 3 with the drive gearwheel 4 installed on the combine 5. The specific embodiment of the positive engagement of the traction rack with the drive gearwheel described herein shall not restrict the spirit and scope of the invention, and the positive engagement may be achieved by any other appropriate means.

In order to reduce the wear of the drive gearwheel and improve the conditions for its engagement with the traction rack, the drive gearwheel may be provided with a retainer 26 (FIG. 3) which is made in the form of a ring installed on the hub of the drive gearwheel 4.

To facilitate assembly and disassembly, the end pins 11 and 12 (FIG. 4) may be fixed to the intermediate member 10 by means of cotter pins 27 and 28.

The cantilever arm 9 may be secured to the pivot 8 either rigidly or for rotation about the pivot 8, e.g., by means of a wire ring 29.

In operation the combine 5 (FIG. 1) moves along the tubular tracks 2. The movement is effected owing to the engagement of the drive gearwheel 4 coupled to the combine feed mechanism with the traction rack 3 extending along the track 2 in the direction of movement of the combine 5. By virtue of the lantern-wheel gearing consisting of the drive gearwheel and the traction rack 3, the combine 5 moves smoothly along the track 2.

Upon a change in the relief of the seam, the conveyor structure bends at the joints between its members. At the same time, the track 2 is bent at pivotal joints between its segments. This also causes bending of the traction rack 3. The bending of the traction rack 3 is caused by rotation of the adjacent segments about the end pins 11 and 12 (FIG. 4) which are at the same level with the remaining pins of the traction rack 3 and which have the same pitch that does not change upon bending of the traction rack 3. By effecting thereby positive engagement of the traction rack 3 (FIG. 1) with the drive gearwheel 4, their reliable engagement during the movement of the combine along a complicated relief of the seam is ensured. In case it is required to turn the combine about the track 2 (FIG. 2) with respect to the horizontal axis A, e.g., into a position B or C, this may be easily done without misengagement in the gearing consisting of the drive gearwheel and traction rack 3, owing to the pivotal connection between the traction rack 3 and the track 2. This turn is not unfrequently desired from the process point of view when a dip angle of seam changes, sudden obstructions occur on the path of movement of the combine, and the like.

Therefore, the invention improves the efficiency of steering of the combine in seams with intricate relief, makes the feed system of the combine more reliable in operation, and improves safety of operators at the sloping face.

INDUSTRIAL APPLICABILITY

The invention may find application in mechanized complexes designed for working coal and coal shale deposits and also for the recovery of non-ferrous and rare-earth metal ores occurring in ore bodies at varying angle of dip.

The invention may also be used in feed systems of various machines moved by means of a rack mechanism over a surface with varying angles of slope.

We claim:

1. A feed system of a mining combine comprising: a drive gearwheel installed on said combine; a track consisting of individual tubular segments connected to one another for limited relative rotation; a traction rack extending along said track and being engageable with said drive gearwheel, said traction rack consisting of individual pivotally interconnected segments including side members interconnected by equally spaced pins, said pins meshing with said drive gearwheel; and pivotal joints connecting said traction rack to said track for rotation thereabout, said pivotal joints being located at points of joints between said segments of said track; wherein positive engagement of said rack with said drive gearwheel is maintained.

2. A feed system of a mining combine according to claim 1, wherein the pivotal joints include pivots having ends received in adjacent tubular segments of the track for limited axial displacement, and cantilever arms secured to the middle portions of the pivots; and the segments of the traction rack have intermediate members for pivotally interconnecting the segments, the intermediate members being rigidly connected to the cantilever arms.

3. A feed system of a mining combine according to claim 2, wherein the cantilever arms are connected to the intermediate members to which are secured end pins of adjacent segments of the traction rack in such a manner that they have the same pitch as the pitch of the pins of the traction rack, the segments being rotatable about the end pins.

* * * * *